US010781076B2

(12) United States Patent
Blanchard et al.

(10) Patent No.: US 10,781,076 B2
(45) Date of Patent: Sep. 22, 2020

(54) ELEVATOR BUFFER SYSTEM

(71) Applicant: OTIS ELEVATOR COMPANY, Farmington, CT (US)

(72) Inventors: Antoine Adrian Blanchard, Chateauneuf sur Loire (FR); Denis Gauthier, Saint Cyr en Val (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 296 days.

(21) Appl. No.: 15/752,468

(22) PCT Filed: Aug. 17, 2015

(86) PCT No.: PCT/IB2015/001553
§ 371 (c)(1),
(2) Date: Feb. 13, 2018

(87) PCT Pub. No.: WO2017/029533
PCT Pub. Date: Feb. 23, 2017

(65) Prior Publication Data

US 2019/0010025 A1 Jan. 10, 2019

(51) Int. Cl.
*B66B 5/28* (2006.01)

(52) U.S. Cl.
CPC ..... *B66B 5/284* (2013.01); *B66B 5/282* (2013.01)

(58) Field of Classification Search
CPC ..... B66B 5/284; B66B 5/282
See application file for complete search history.

(56) References Cited

U.S. PATENT DOCUMENTS 688,601 A * 12/1901 Dean ..... B66B 5/282 187/344
5,181,586 A * 1/1993 Yoo ..... B66B 7/08 187/411
5,307,904 A * 5/1994 Yoo ..... B66B 5/284 187/343

(Continued)

FOREIGN PATENT DOCUMENTS

CN 1771185 A 5/2006
CN 201737554 U 2/2011

(Continued)

OTHER PUBLICATIONS

International Search Report for application No. PCT/IB2015/001553 dated Jul. 18, 2016; 8 pages.

(Continued)

*Primary Examiner* — Michael A Riegelman
(74) *Attorney, Agent, or Firm* — Cantor Colburn LLP

(57) ABSTRACT

An elevator buffer system includes a buffer (44), a frame (30) spaced above the buffer, a platform (48) spaced above the frame, and a pre-compressed pad device (52) disposed between the frame and the platform and engaged to one of the frame and the platform. The system is constructed to move between a non-strike position, where the pre-compressed pad device is spaced from the other of the frame and the platform; a mid-strike position, where the pre-compressed pad device is in contact with the other of the frame and the platform; and a full-strike position, where the pre-compressed pad device is further compressed against the other of the frame and the platform.

13 Claims, 3 Drawing Sheets

(56) References Cited

U.S. PATENT DOCUMENTS 5,402,861 A * 4/1995 Kohara ..... B66B 11/0286 187/292
5,411,117 A * 5/1995 Hayrinen ..... B66B 5/26 187/345
5,421,433 A * 6/1995 Yoo ..... B66B 1/3484 177/168
5,513,724 A * 5/1996 De Jong ..... B66B 5/284 187/264
5,613,667 A * 3/1997 Ho ..... B66B 11/0273 248/621
5,750,945 A * 5/1998 Fuller ..... B66B 1/30 187/292
6,315,084 B1 * 11/2001 Shon ..... B66B 7/08 187/292
6,443,266 B2 * 9/2002 Murakami ..... B66B 7/046 187/401
6,668,980 B2 * 12/2003 Smith ..... B66B 11/0266 187/292
7,383,924 B2 * 6/2008 Izumi ..... B66B 7/027 187/250
7,810,611 B2 * 10/2010 Zeng ..... B66B 11/0206 187/401
8,047,335 B2 * 11/2011 Fargo ..... B66B 7/10 187/411
8,141,685 B2 * 3/2012 Utsunomiya ..... B66B 11/028 187/292
9,580,277 B2 * 2/2017 Metsanen ..... B66B 11/0206
9,718,644 B2 * 8/2017 Kyue ..... B66B 11/0226
2003/0102613 A1 * 6/2003 Alves ..... B66B 7/046 267/140
2006/0249337 A1 * 11/2006 McNamara ..... B66B 5/282 187/412
2008/0289909 A1 * 11/2008 Kato ..... B66B 5/282 187/343
2011/0056770 A1 * 3/2011 Qiu ..... B66B 11/02 187/266
2012/0145489 A1 * 6/2012 Tian ..... B66B 11/0045 187/406
2019/0010025 A1 * 1/2019 Blanchard ..... B66B 5/282
2019/0084801 A1 * 3/2019 Blanchard ..... B66B 5/12

FOREIGN PATENT DOCUMENTS

| | | | |
|---|---|---|---|
| CN | 202251652 | U | 5/2012 |
| CN | 202542650 | U | 11/2012 |
| CN | 202690875 | U | 1/2013 |
| CN | 202808101 | U | 3/2013 |
| EP | 1236670 | B1 | 12/2008 |
| JP | S5112548 | A | 1/1976 |
| JP | 2001151435 | A | 6/2001 |
| KR | 20010028746 | A | 4/2001 |
| WO | 2004108576 | A1 | 12/2004 |

OTHER PUBLICATIONS

Written Opinion of the International Searching Authority for application No. PCT/IB2015/001553 dated Jul. 18, 2016; 10 pages.
Chinese Office Action for Application No. 201580082544 dated Apr. 16, 2019; 7 pages.

* cited by examiner

ELEVATOR BUFFER SYSTEM

CROSS-REFERENCES TO RELATED APPLICATIONS

This patent application is a US National Stage Application of PCT/IB2015/001553, filed Aug. 17, 2015, which is incorporated herein by reference in its entirety.

BACKGROUND

The present disclosure relates to an elevator system, and more particularly, to an elevator buffer system.

Elevator systems include an enclosed car for transporting passengers and/or cargo vertically in a hoistway. The car typically includes four sidewalls, a ceiling, and a floor or platform. For structural support and vertical movement, the car is typically supported by a cradle or frame engaged directly to a driving apparatus (e.g. cabled, linear motors, hydraulic, etc.). Elevator systems may also include buffers arranged at the floor or bottom of the elevator system hoistway designed as a safety measure and/or to minimize damage to the elevator system, and/or passenger discomfort, during unusual events. More specifically, the buffers are constructed to experience an elevator system car strike should the car overrun the lowermost stopping position in the hoistway.

Known buffer arrangements may also include isolation pads located about the periphery of the platform and generally between the platform and the lower frame. Should an elevator system car overrun the lowermost limit, the buffer strikes the frame and at least a portion of the force may be transmitted to the car platform through the peripheral isolation pads. Unfortunately, the distribution of force throughout the platform is limited, leading to less than ideal frame optimization. Further enhancements of strike force distribution and structural support relative to buffer arrangements is desirable.

SUMMARY

An elevator system according to one, non-limiting, embodiment includes a buffer; a frame; a platform spaced from the frame; and a pre-compressed pad device disposed between the frame and the platform and engaged to one of the frame and the platform and spaced from the other of the frame and the platform.

Additionally to the foregoing embodiment, the frame is spaced above the buffer and the platform is spaced above the frame.

In the alternative or additionally thereto, in the foregoing embodiment, the elevator system is configured to adapt at least one of a non-strike position with the pre-compressed pad device being spaced from the other of the frame and the platform, a mid-strike position with the pre-compressed pad device being in contact with the other of the frame and the platform, and a full-strike position with the pre-compressed pad device being further compressed against the other of the frame and the platform.

In the alternative or additionally thereto, in the foregoing embodiment, the system includes at least one isolation pad disposed between and in contact with the frame and the platform, wherein the at least one isolation pad is substantially uncompressed when in the non-strike position, is partially compressed when in the mid-strike position, and is more compressed when in the full-strike position.

In the alternative or additionally thereto, in the foregoing embodiment, the at least one isolation pad includes first and second isolation pads and the pre-compressed pad device is spaced between the first and second isolation pads.

In the alternative or additionally thereto, in the foregoing embodiment, the first and second isolation pads are each in continuous contact with the frame and the platform.

In the alternative or additionally thereto, in the foregoing embodiment, the pad device is engaged to the frame.

In the alternative or additionally thereto, in the foregoing embodiment, the pre-compressed pad device includes a resiliently compressible pad, a plate, and a member extending in a direction of strike, and wherein the member slideably extends through the frame and is engaged to the plate with the compressible pad being pre-compressed between the frame and the plate.

In the alternative or additionally thereto, in the foregoing embodiment, the resiliently compressible pad and the first and second isolation pads are made of the same material.

In the alternative or additionally thereto, in the foregoing embodiment, the compressible pad and the first and second isolation pads have a substantially equivalent geometry when in a non-compressed state.

In the alternative or additionally thereto, in the foregoing embodiment, the frame includes a first side in contact with the resiliently compressible pad and an opposite second side, and the member includes a shaft engaged to the plate and extending through the frame and an enlarged head engaged to the shaft and in biased contact with the second side when in the non-strike position.

In the alternative or additionally thereto, in the foregoing embodiment, the shaft extends through an isolation washer of the pre-compressed pad device disposed between the second side and the enlarged head.

In the alternative or additionally thereto, in the foregoing embodiment, as the system moves from the mid-strike position to the full-strike position, the pre-compressed pad device is further compressed by a first distance that is substantially equal to a second distance that the at least one isolation pad is further compressed.

In the alternative or additionally thereto, in the foregoing embodiment, as the system moves from the non-strike position to the mid strike position, the at least one isolation pad is compressed by a third distance that is substantially equal to a gap between the pre-compressed pad device and the other of the frame and the platform when in the non-strike position.

In the alternative or additionally thereto, in the foregoing embodiment, the platform is generally the floor of an elevator system car and the frame supports the car for vertical movement.

A method of operating an elevator system according to another, non-limiting, embodiment includes striking of a frame against a buffer; moving of the frame toward a platform; compressing of peripheral isolation pads located between the frame and the platform; further moving the frame toward the platform; further compressing of the peripheral isolation pads; and compressing of a central pad.

Additionally to the foregoing embodiment, the peripheral isolation pads and the central pad are resiliently compressible.

In the alternative or additionally thereto, in the foregoing embodiment, the central pad is pre-compressed.

In the alternative or additionally thereto, in the foregoing embodiment, the method includes distributing an impact force substantially evenly across the platform.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
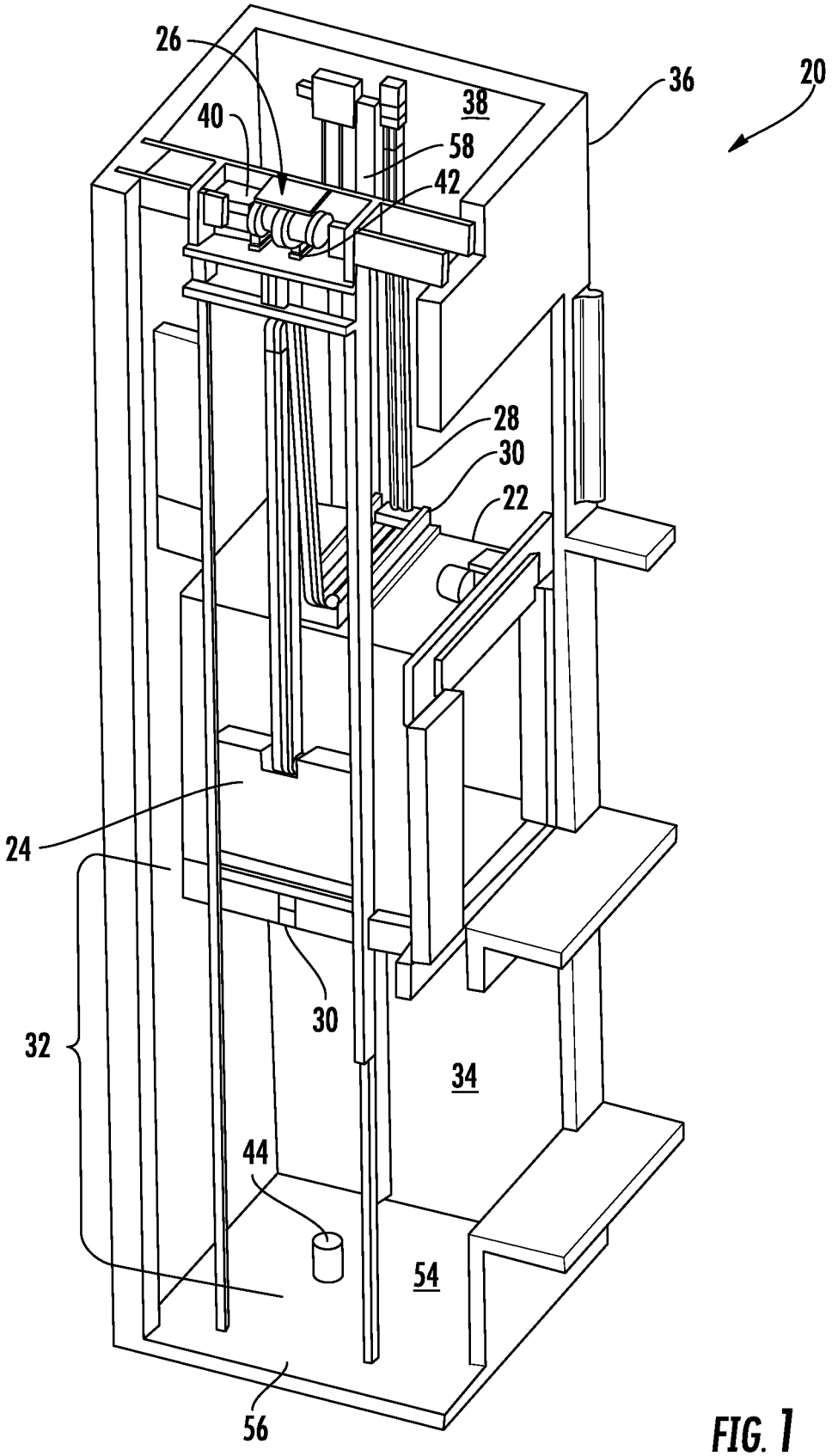
FIG. 1 is a perspective view of an elevator system having a buffer system and with parts broken away to show internal detail as one, non-limiting, exemplary embodiment of the present disclosure.

Referring to FIG. 1, an elevator system 20 of the present disclosure is illustrated, and may include a car 22, a counterweight 24, a drive device 26, a rope 28, a structural frame or sling 30 and a buffer system 32. The car 22 may carry passengers or other objects and is constructed to move substantially vertically in a hoistway 34 of the elevator system 20. Boundaries of the hoistway 34 may be defined by a stationary structure or building 36 that may utilize and house the elevator system 20. The drive device 26 may be housed in a machine room 38 of the building 36 located generally above the hoistway 34, and may include an electric motor 40 that rotates a sheave 42. The rope 28 is wrapped about the sheave 42 and extends between the car 22 and the counterweight 24 such that when the drive device 26 receives a command signal to raise the car 22, the sheave 42 rotates in a first direction that lowers the counterweight 24 as the car 22 rises, and vice-versa. The counterweight 24 generally weighs about the same as the car 22 when at about fifty percent capacity, and thus reduces the work output requirements of the drive device 26.

Figure 2:
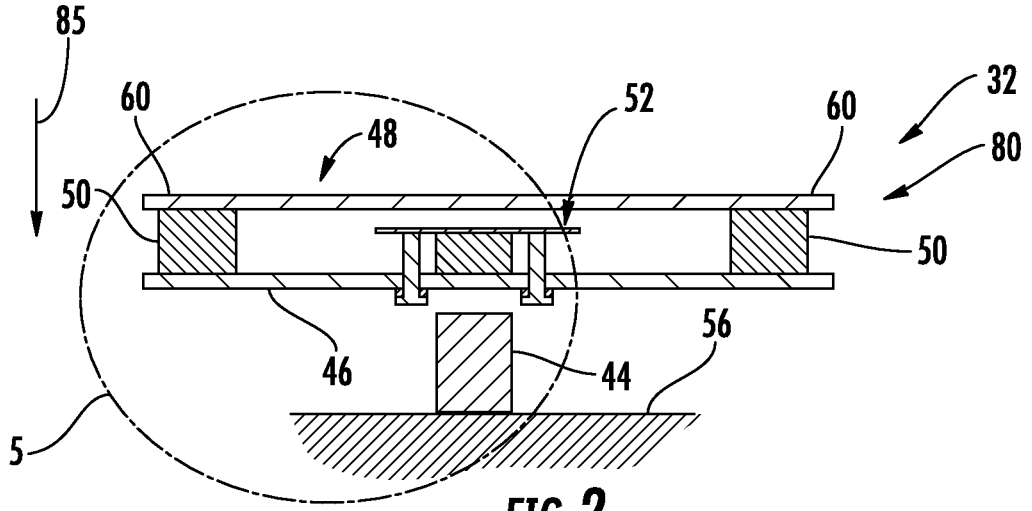
FIG. 2 is a schematic of the buffer system illustrated in a non-strike position.

Referring to FIGS. 1 and 2, the elevator buffer system 32 is constructed to stop a descending car 22 that travels beyond a normal lower limit, and softens the force with which the car 22 runs into a pit area during emergencies. During normal operation, the elevator buffer system 32 may also isolate the car 22 from vibrations and noise providing a more comfortable ride for passengers. The elevator buffer system 32 may include a buffer 44, a horizontal portion 46 of frame 30, a platform 48, a plurality of isolation pads 50, and a pre-compressed pad device 52. The buffer 44 is generally positioned in a pit area 54 of the hoistway 34 and projects upward from a bottom floor 56 in the pit area 54. The horizontal portion 46 of frame 30 may generally extend across the bottom of the car 22 and may be part of the structural frame or sling 30 that generally wraps about the car and facilitates connection to the rope 28 and guide rails 58 in the hoistway 34. The platform 48 may generally be the floor of the car 22 and is spaced above the frame portion 46 by the plurality of isolation pads 50 distributed about a periphery or outer edge 60 of the platform 48. The pre-compressed pad device 52 is also located between the frame portion 46 and the platform 48 and may be centrally positioned with respect to the platform periphery 60 (i.e., spaced horizontally between the isolation pads 50).

During normal elevator system 20 operation, the isolation pads 50 provide a degree of vibration and noise isolation between the frame portion 46 of the sling 30 and the platform or floor 48 of the car 22 thus contributing toward passenger comfort. The isolation pads 50 may extend vertically between and may be in continuous contact with the platform 48 and the frame portion 46.

Figure 5:
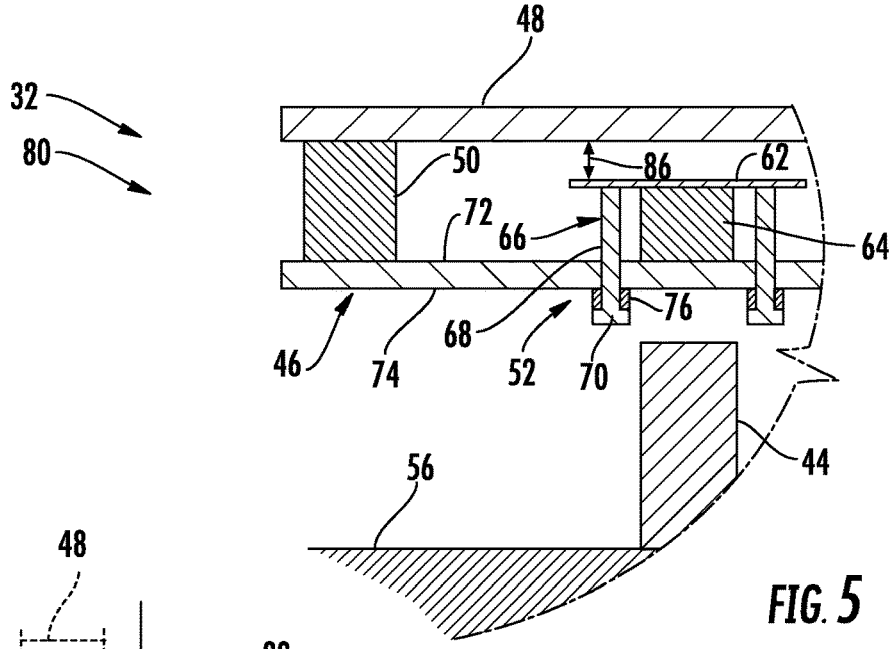
FIG. 5 is an enlarged view of the buffer system taken from circle 5 in FIG. 2.

Referring to FIG. 5 and during normal elevator system 20 operation, the pad device 52 is pre-compressed and remains capable of further compression at a pre-specified point during a buffer strike. The device 52 may include a plate 62, a pad 64 that may be resiliently compressible, and an elongated member 66. The member 66 (i.e., two illustrated) may include a shaft 68 projecting outward from an enlarged head 70 of the member 66. When assembled and during normal elevator system 20 operation, the pad 64 that may be centrally located with respect to the isolation pads 50 is compressed between the plate 62 and an upward facing side 72 of the frame portion 46. The shaft 68 of the member 66 is engaged to the plate 62 at one end and projects slideably through the frame portion 46 to the enlarged head 70. The enlarged head 70 is generally biased against an opposite second side 74 of the frame portion 46 via the resilient force of the pre-compressed pad 64. The device 52 may further include isolation washers 76 located between the second side 74 of the frame portion 46 and the enlarged head 70 of the member 66, and through which the shaft 68 extends. It is further contemplated and understood that the elevator system 20 may include several buffers 44 and several pad devices 52 associated with any one elevator car 22.

Figure 3:
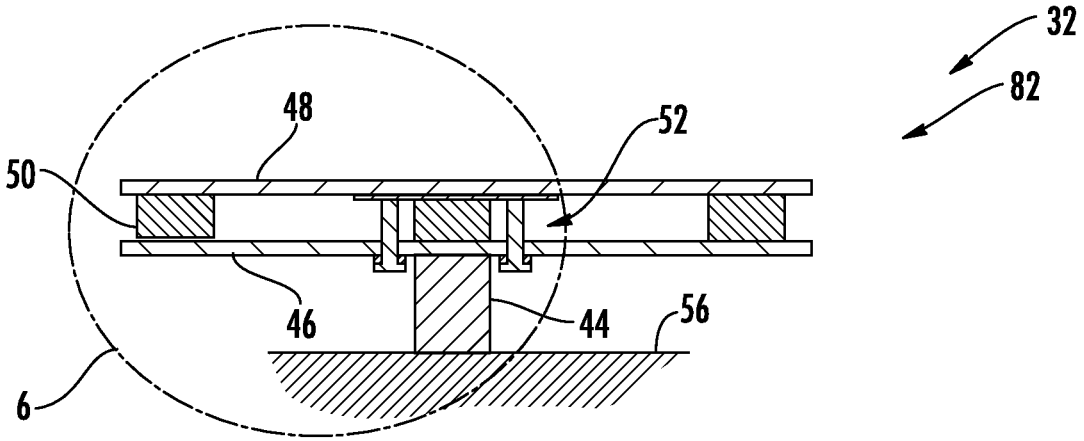
FIG. 3 is a schematic of the buffer system illustrated in a mid-strike position.
Figure 4:
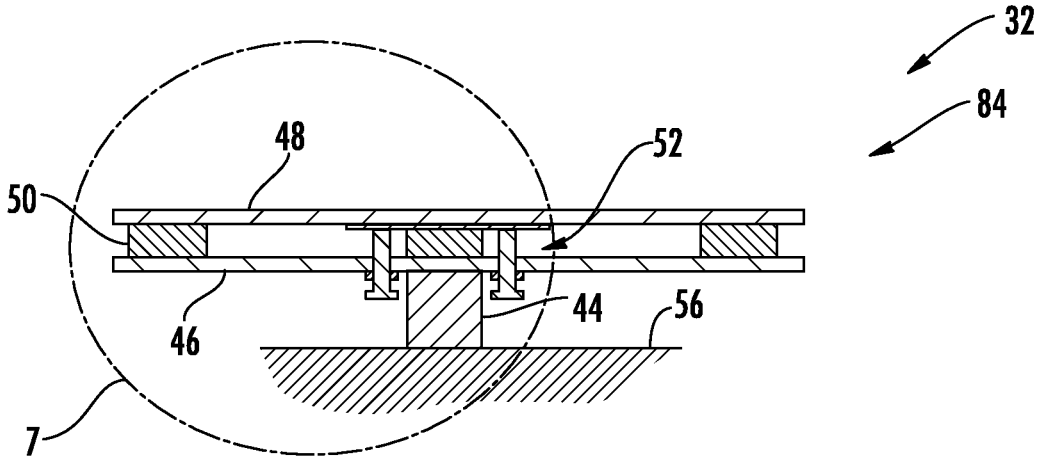
FIG. 4, is a schematic of the buffer system illustrated in a full-strike position.
Figure 6:
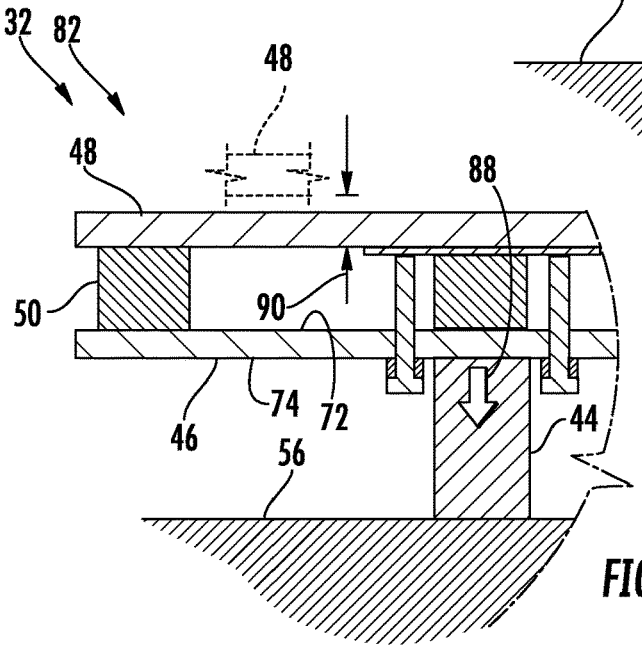
FIG. 6 is an enlarged view of the buffer system taken from circle 6 in FIG. 3.
Figure 7:
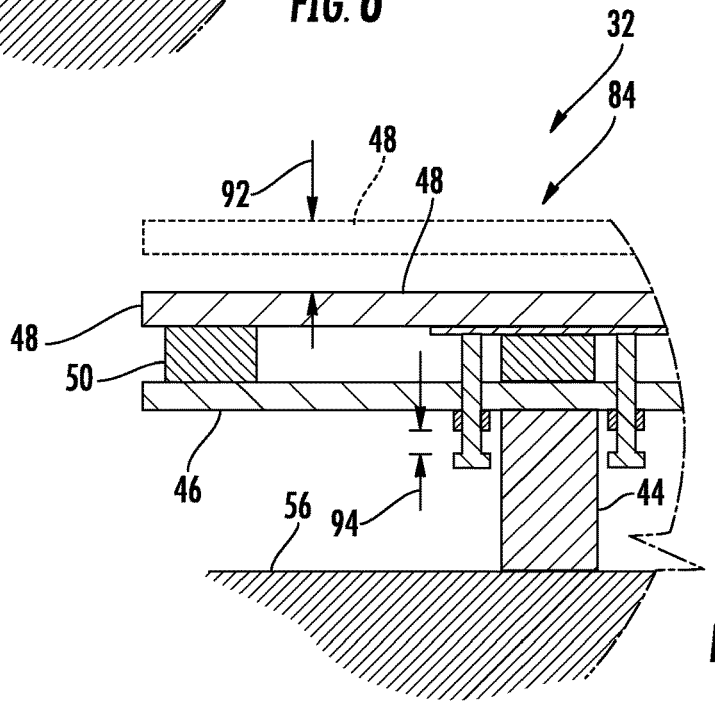
FIG. 7 is an enlarged view of the buffer system taken from circle 7 in FIG. 4.

The elevator buffer system 32 is configured to move through and between a non-strike position 80 (see FIGS. 2 and 5) that generally exists during normal operation of the elevator system 20, a mid-strike position 82 (see FIGS. 3 and 6) that generally occurs upon striking of the frame portion 46 with the buffer 44, and a full-strike position 84 (see FIGS. 4 and 7) that generally occurs with the continued downward momentum of the car 22. During elevator system 20 operation and prior to a buffer strike, the elevator buffer system 32 is in the non-strike position 80 such that the isolation pads 50 are generally not compressed except for the weight of the car 22 and the passengers. Also, the plate 62 is spaced from the platform 48 by a gap or distance (see arrow 86 in FIG. 5), the enlarged heads 70 are generally biased against the isolation washer 76 that is biased against the second side 74 of the frame portion 46, and the buffer 44 is spaced below the frame portion 46.

Upon a buffer strike in a strike direction (see arrow 85 in FIG. 3), the elevator buffer system 32 moves from the non-strike position 80 toward the mid-strike position 82. During this movement, the second side 74 of the frame portion 46 contacts the buffer 44 causing the buffer 44 to resiliently compress vertically. Continued downward motion of the car 22 causes the force (see arrow 88 in FIG. 6) placed upon the buffer 44 to increase whereupon the isolation pads 50 begin to compress vertically as the platform 48 moves closer to the plate 62 of the pre-compressed pad device 52 and the frame portion 46. During this period, the pre-compressed pad 64 of the device 52 does not compress further and the enlarged heads 70 remain biased against the second side 74 of the frame portion 46.

With continued downward motion (i.e., the strike direction 85) of the car 22, the elevator buffer system 32 enters the mid-strike position 82 when the isolation pads 50 are vertically compressed by a distance (see arrow 90 in FIG. 6) substantially equal to the gap 86 measured when the buffer system 32 is in the non-strike position 80. At this point, the plate 62 is in initial contact with the platform 48, the isolation pads 50 and the buffer 44 may continue to compress, and the pre-compressed pad 64 begins to compress further as the enlarged heads 70 of the member 68 move downward and away from the second side 74 of the frame portion 46. The contact of the plate 62 with the platform 48 has the effects of evenly distributing the impact force across the platform 48, stiffening the frame portion 46, and enables improved structural optimization. The total distance (see arrow 92 in FIG. 7) that the isolation pad 50 moves as a result of compression is generally equal to the gap 86 (see FIG. 5) plus a distance (see arrow 94 in FIG. 7) that the enlarged head 70 moves away from the washer 76 (i.e., bottom side 74 of the frame portion 46).

The buffer 44 may be any variety of buffers including coiled spring buffer, resilient material buffer (e.g., cellular polyurethane) and hydraulic or oil buffers. The isolation pads 50 and the pre-compressed pad 64 may be made of the same resiliently compressible material, such as, for example, rubber. The isolation pad 50 and the pre-compressed pad 64 (i.e., in the uncompressed state), may have substantially the same equivalent load versus deflection characteristics. To simplify structural calculations, the isolation pads 50 may be of the same size and geometric shape as the pad 64 when not compressed. It is further contemplated and understood that various components may be reversed. For example, the pre-compressed pad device 52 may be carried by the platform 48 and spaced from the frame portion 46 when the buffer system 32 is in the non-strike position 80.

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. An elevator system comprising:

a buffer;

a frame;

a platform spaced from the frame; and a pre-compressed pad device disposed between the frame and the platform and engaged to one of the frame and the platform and spaced from the other of the frame and the platform, wherein the frame is spaced above the buffer and the platform is spaced above the frame, and wherein the elevator system is configured to adapt at least one of a non-strike position with the pre-compressed pad device being spaced from the other of the frame and the platform, a mid-strike position with the pre-compressed pad device being in contact with the other of the frame and the platform, and a full-strike position with the pre-compressed pad device being further compressed against the other of the frame and the platform.

2. The elevator system set forth in claim 1 further comprising:

at least one isolation pad disposed between and in contact with the frame and the platform, wherein the at least one isolation pad is substantially uncompressed when in the non-strike position, is partially compressed when in the mid-strike position, and is more compressed when in the full-strike position.

3. The elevator system set forth in claim 2, wherein the at least one isolation pad includes first and second isolation pads and the pre-compressed pad device is spaced between the first and second isolation pads.

4. The elevator system set forth in claim 3, wherein the first and second isolation pads are each in continuous contact with the frame and the platform.

5. The elevator system set forth in claim 4, wherein the pre-compressed pad device is engaged to the frame.

6. The elevator system set forth in claim 5, wherein the pre-compressed pad device includes a resiliently compressible pad, a plate, and a member extending in a direction of strike, and wherein the member slideably extends through the frame and is engaged to the plate with the compressible pad being pre-compressed between the frame and the plate.

7. The elevator system set forth in claim 6, wherein the resiliently compressible pad and the first and second isolation pads are made of the same material.

8. The elevator system set forth in claim 6, wherein the resiliently compressible pad and the first and second isolation pads have a substantially equivalent geometry when in a non-compressed state.

9. The elevator system set forth in claim 6, wherein the frame includes a first side in contact with the resiliently compressible pad and an opposite second side, and the member includes a shaft engaged to the plate and extending through the frame and an enlarged head engaged to the shaft and in biased contact with the second side when in the non-strike position.

10. The elevator system set forth in claim 9, wherein the shaft extends through an isolation washer of the pre-compressed pad device disposed between the second side and the enlarged head.

11. The elevator system set forth in claim 1, wherein as the system moves from the mid-strike position to the full-strike position, the pre-compressed pad device is further compressed by a first distance that is substantially equal to a second distance that the at least one isolation pad is further compressed.

12. The elevator system set forth in claim 1, wherein as the system moves from the non-strike position to the mid strike position, the at least one isolation pad is compressed by a third distance that is substantially equal to a gap between the pre-compressed pad device and the other of the frame and the platform when in the non-strike position.

13. The elevator system set forth in claim 1, wherein the platform is generally the floor of an elevator system car and the frame supports the car for vertical movement.

* * * * *